US006887115B2

(12) United States Patent
Borgli

(10) Patent No.: US 6,887,115 B2
(45) Date of Patent: May 3, 2005

(54) PROPULSION MEANS FOR A BOAT

(76) Inventor: Gunnar Borgli, Stasjonsveien 16B, Skjeberg (NO)

( * ) Notice: Subject to any disclaimer, the term of this patent is extended or adjusted under 35 U.S.C. 154(b) by 0 days.

(21) Appl. No.: 10/203,005

(22) PCT Filed: Jan. 31, 2001

(86) PCT No.: PCT/NO01/00033

§ 371 (c)(1),
(2), (4) Date: Oct. 24, 2002

(87) PCT Pub. No.: WO01/56874

PCT Pub. Date: Aug. 9, 2001

(65) Prior Publication Data

US 2003/0077956 A1 Apr. 24, 2003

(30) Foreign Application Priority Data

Feb. 4, 2000 (NO) ..... 20000583

(51) Int. Cl.[7] ..... B63H 21/20
(52) U.S. Cl. ..... 440/3; 440/38
(58) Field of Search ..... 440/3, 4, 38

(56) References Cited

U.S. PATENT DOCUMENTS 1,325,275 A * 12/1919 Clough ..... 440/38
4,461,620 A 7/1984 Brachet
4,568,289 A * 2/1986 Heidrich et al. ..... 440/3
5,520,558 A * 5/1996 Kobayashi ..... 440/38

FOREIGN PATENT DOCUMENTS

JP 09142384 A 6/1997
JP 09142385 A 6/1997

* cited by examiner

*Primary Examiner*—Jesus D. Sotelo
(74) *Attorney, Agent, or Firm*—Nixon & Vanderhye PC

(57) ABSTRACT

A propulsion aggregate for boats of planing type is disclosed. The aggregate (10) comprises at least one inboard engine (5) disposed in a supporting frame (6), at least one first drive shaft (1) having a propeller (3), which shaft (1) extends through the boat hull (11) at the stern section of the boat, at least one rudder (12), and a second drive shaft (2) that extends through the stern section of the boat and drives a water turbine (4). The first drive shaft (1) is in direct connection with the power take-off (7) of the engine (5) via a releasable coupling (8) and said first drive shaft (1) is in operation during forward propulsion above a certain speed only, and the second drive shaft (2) is connected to the power take-off (7') of the engine (5) and is arranged at a higher level than the propeller (3) and said second drive shaft (2) is in operation at forward propulsion at low speeds and at reverse motion.

11 Claims, 4 Drawing Sheets

PROPULSION MEANS FOR A BOAT

Figure 1:
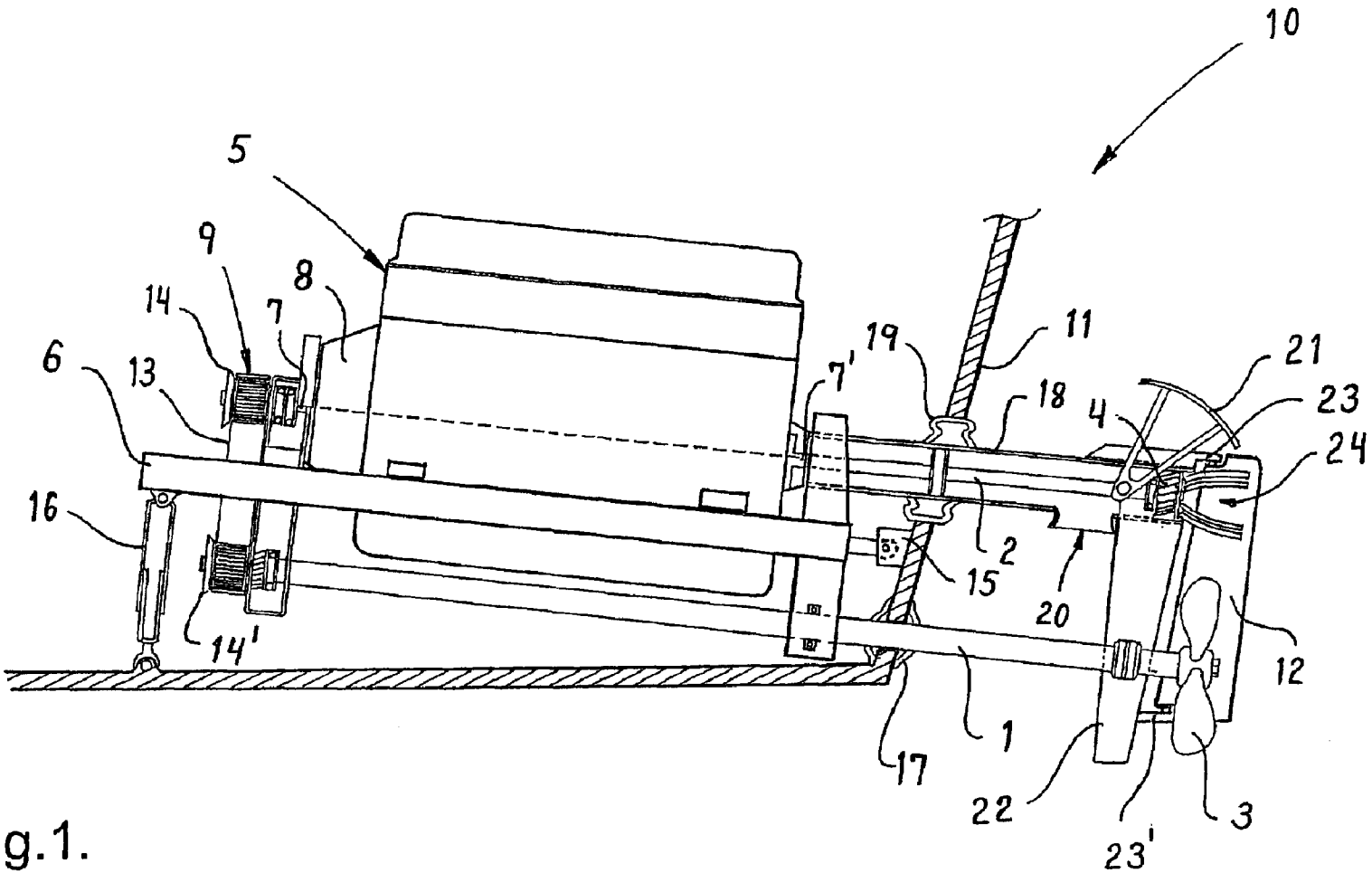

This application is the U.S. national phase of international application PCT/NO01/0033 filed 31 Jan. 2001, which designated the U.S.

The present invention relates to a propulsion aggregate for a boat of planing type, which aggregate comprises at least one inboard engine disposed in a supporting frame, at least one first drive shaft having a propeller, which shaft extends through the boat hull at the stern section of the boat and at least one rudder.

The propulsion aggregate is in particular developed with regard to planing boats of smaller and medium sized type. The aggregate is in particular suited for boat hulls which during high speeds just touch the water surface at the stern section of the hull. This however, is not to be understood as a limitation.

One object of the invention has been to provide a propulsion aggregate that consists of as few components as possible and is to render internal friction in the drive gear to a minimum.

In stern mounted aggregates having powerful engines, it has been a problem to make the drive gear, which transmits the engine power to the propeller, to last. It is not unusual that the drive gear has to be overhauled once a year. It is further a known matter that the drive gear within the aggregate stern including transmission and its many gears, is a source to great losses in power output.

According to the present invention a propulsion aggregate of the introductorily described type is provided, which is characterised in that the aggregate comprises a second drive shaft that extends through the stern section of the boat and drives a water turbine, that the first drive shaft is in direct connection with the power take-off of the engine via a releasable coupling and is in operation during forward propulsion above a certain speed only, and that also the second drive shaft is connected to the power take-off of the engine and is arranged at a higher level than the propeller and is in operation at forward propulsion at low speeds and at reverse motion of the boat.

The propeller can be a conventional boat propeller, optionally a surface acting propeller of the type that is designed for speedboats.

In a first embodiment the power take-off of the engine for the first drive shaft is directed forward of the boat, and this first drive shaft is extended to the power take-off and is connected to this via a power transmission unit, and the power take-off for the second drive shaft is directed rearwards. In practise this implies that a conventional inboard engine will be turned around having the engine front facing rearwards and the flange of the crankshaft facing forwards.

In a second embodiment the power take-off of the engine for the first and the second drive shafts are directed rearward of the boat and the first drive shaft is connected to the power take-off via a power transmission unit. In practise this implies an engine that is arranged with the front thereof in normal speed direction.

Suitably the power transmission unit can be in form of a cogged belt and two supported pulleys that the cogged belt runs over.

It may be desired to have two propellers that are driven by one engine. In such an embodiment a third drive shaft corresponding to the first drive shaft can be arranged adjacent to and spaced apart from the first drive shaft, but at the same level, and the power transmission unit be so arranged that the shafts rotate in opposite directions.

In order to obtain substantial propulsion power, two engines can be installed. The propulsion aggregate do then have two inboard engines placed adjacent to each other and can, in a first embodiment, be so arranged that they have respective drive shafts and propellers rotating in opposite directions.

In another embodiment the propulsion aggregate including the two inboard engines placed adjacent to each other, be so arranged that they have a common drive shaft and propeller.

In a preferable embodiment the propulsion aggregate is tiltable about a substantially horizontal axis that is located near the stern section of the boat. This provides an option to optimise the inclination of the stern drive shaft during driving in order to obtain best possible effect and speed of the boat.

One way to provide this is that the propulsion aggregate is tiltable about the substantially horizontal axis by means of at least one working cylinder that is located near the front end of the support frame.

Figure 2:
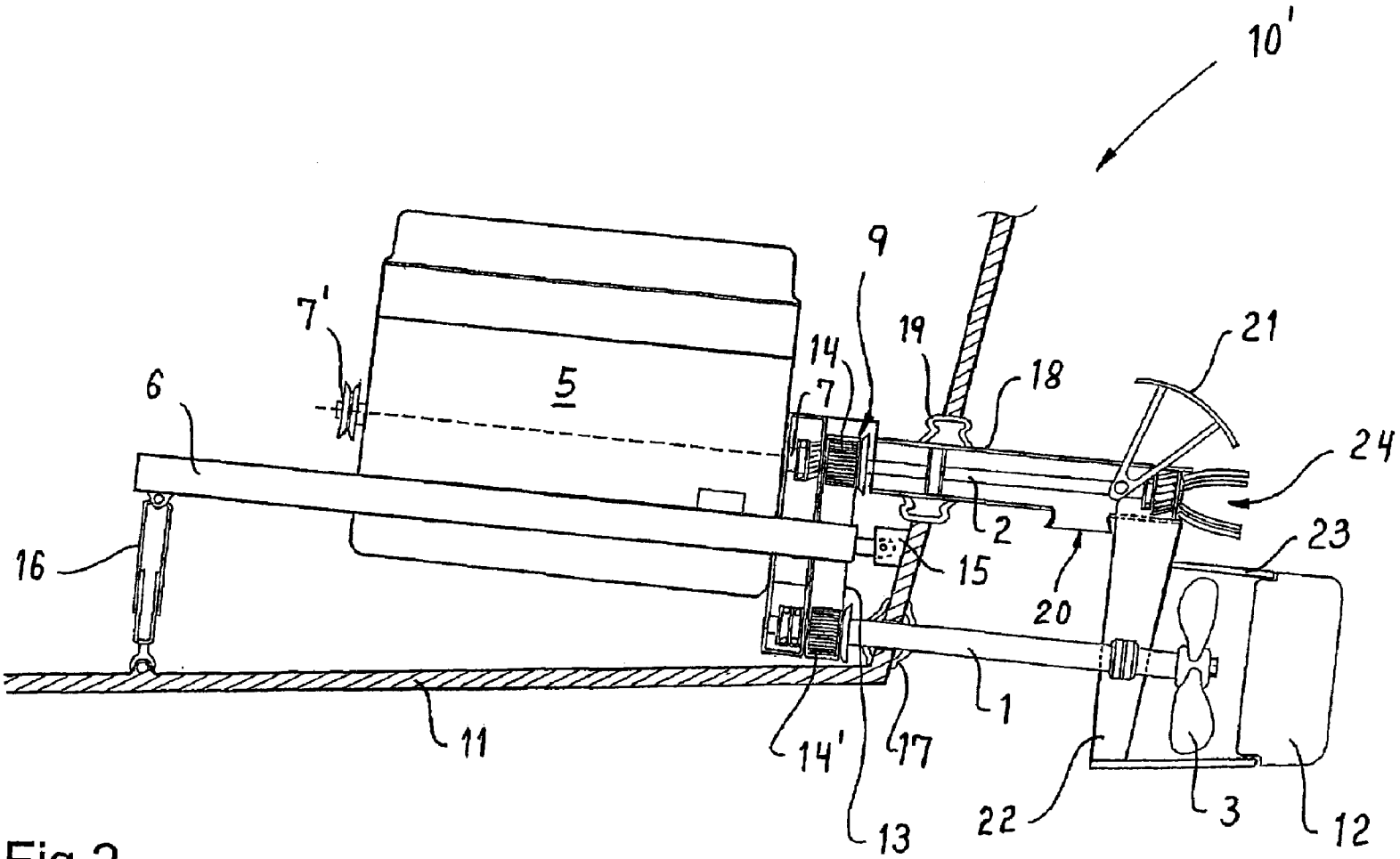

Other and further objects, features and advantages will appear from the following description of preferred embodiments of the invention, which is given for the purpose of description, without thereby being limiting, and given in context with the appended drawings where:

FIG. 1 shows schematically a side view of a first embodiment of a propulsion aggregate according to the invention, mounted in the stern section of a boat hull, FIG. 2 shows schematically a side view of a second embodiment of a propulsion aggregate according to the invention, mounted in the stern section of a boat hull, FIGS. 3A–3D shows schematically the water line during four different operating conditions of a boat having the propulsion aggregate according to the invention, FIGS. 4A–4D shows schematically some alternative combinations of the propulsion engines and drive shafts in a propulsion aggregate according to the invention.

Reference is firstly given to FIG. 1 that shows a first embodiment of a propulsion aggregate 10 according to the invention. The propulsion aggregate 10 is located in the stern section of a boat hull 11. The propulsion aggregate 10 comprises a drive engine 5, which in this embodiment is turned opposite the speed direction; i.e. the front of the engine 5 faces the stern of the boat. The Engine 5 is mounted to a support frame 6 that is pivotably supported to a mount 15 at the stern section of the boat. A working cylinder 16 is arranged between the bottom of the boat and the support frame 6 near the front end thereof.

A first drive shaft 1 is in driving connection with the engine power take-off 7, i.e. the engine crankshaft, via a power transmission unit 9 and a coupling such like a clutch 8. The power transmission unit 9 consists briefly of an upper and lower pulley 14,14', which are interconnected by a cogged belt 13. The pulleys 14,14' are supported in respective bearings. The drive shaft 1 is at its font end supported in the same bearing as the lower pulley 14' and the drive shaft 1 is directly coupled to the lower pulley 14'. The first drive shaft 1 is also supported in a second bearing near the boat stern. The drive shaft 1 extends further rearwards through the boat stern and is sealed off by a lead-in boot 17 that prevents water penetration. The drive shaft 1 is supported at the rear end by a third bearing, and a propeller 3 is fixed to the rear end of the drive shaft 1. Preferably the bearings are of the sealed type and packed with grease. At each side of the propeller 3 is respective rudders 12 arranged. Only one rudder 12 is shown.

A second drive shaft 2 is also mounted to the power take-off 7' of the engine 5, i.e. the crankshaft, though in the front end of the engine 5, and the second drive shaft 2 is located at a higher level than the first drive shaft 1. The second drive shaft 2 is in direct connection with a water turbine 4 and these components are placed within an enclosing shell 18. The drive shaft 2 is supported to the shell 18 in a front and rear bearing. The shell 18 extends through the stern section of the boat and is external sealed off by a second boot 19. The shell 18 has an opening 20 facing downwards and operates as water suction. The shell 18 also has a turbine opening 24 facing rearwards. Further, a baffle 21 is provided that can be folded down when reversing the boat is needed. The rudders 12 extend all the way up to the sides of the turbine opening 24.

A brace 22 is secured to the shell 18 and extends down to the first drive shaft 1 and retains the rear bearing thereof. From the shell 18 and the brace 22 are respective projecting arms 23,23' provided, which support the rudders 12. The rudders 12 are pivotally fixed to the arms 23, 23'.

The operation and manoeuvring of the propulsion aggregate 10 will now be described. At normal propulsion of the boat, i.e. from approximately 4 knots and higher, the propeller 3 is used. As it appears, there does not exist any gearbox with those power losses that might cause. The drive shaft 1 for the propeller 3 is in direct connection with the crankshaft of the engine 5, though it can be engaged and disengaged by means of the clutch 8. If a certain gear ratio between the RPM of the engine and the revolution of the drive shaft is desired, this can be provided by having differing diameter of the upper and lower pulleys 14, 14'. This, however, is relations which should be matched for each individual boat in respect of the parameters; power output, type of propeller, hull design and size of the boat. This, however, will not be closer detailed here.

During slow propulsion of the boat, e.g. when the boat is to ease off towards a pier, or during troll fishery, the water turbine 4 is used. The water turbine 4 collects the water from the suction 20, draws the water through the turbine 4 and ejects the water out through the turbine opening 24 at the rear end of the shell 18. During reverse operation, the reverse baffle 21 is turned and guided down in front of the turbine opening 24 and thus redirects forwardly the water flow ejected from the opening 24. A more detailed description of the four operating conditions will be given later with reference to FIGS. 3A–3D.

A second embodiment of the propulsion aggregate 10' will now be described with reference to FIG. 2. Those components corresponding with those in FIG. 1 are given the same reference numbers and will not be described in detail once more. The engine 5 is like before placed in a supporting frame 6 that is pivotable about a horizontal axis through the mount 15.

The major difference between the two embodiments is that the engine 5 now is placed in the "correct" direction having the front thereof facing in the speed direction of the boat, and the power transmission unit 9 is placed in the rear end near the stern of the boat. A coupling, or a clutch, is also present. It is not depicted, but can either be placed elevated adjacent to the first pulley 14 or lower adjacent to the second pulley 14'. The second drive shaft 2 is, like before, in direct connection with the crankshaft of the engine 5. The first drive shaft 1 is substantially shortened in respect of the one shown in FIG. 1 and has two bearings or supports only.

The shell 18 is slightly modified for adaption to the power transmission unit 9, but is otherwise entirely corresponding to the one shown in FIG. 1. For illustrating purposes, the rudder 12 is slightly different designed and placed in the FIG. 2 embodiment. The turbine opening 24 will in this embodiment be in form of a turnable nozzle, which is used to manoeuvre the boat at low speeds and reversing (together with the baffle 21). The rudder 12, which now is one single one, is used at higher speeds.

The advantage with this embodiment is that a more compact unit having a substantially shorter first drive shaft 1 than the first embodiment is provided. An advantage with the first embodiment will be the possibility for a lower construction height, i.e. lowest possible centre of gravity in the placing of the engine near the bottom of the boat.

Figure 3A:
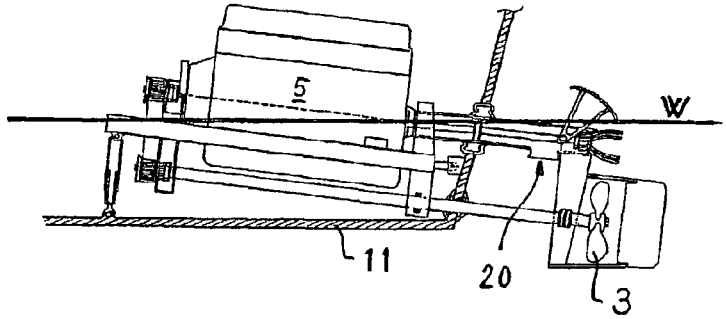

Reference is now given to FIGS. 3A–3D showing four different operating conditions. FIG. 3A shows slow speed, e.g. 0–4 knots, by use of the water turbine and the propeller drive disengaged. The shell 18 including the suction 20 is fully submerged in the water, cf. the water line W. This figure will also be typical for reversing, except that the baffle plate 21 will be turned down in front of the turbine opening 24.

Figure 3B:
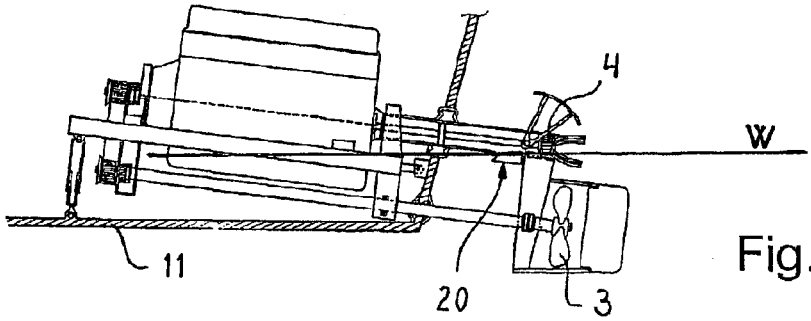

FIG. 3B shows semi planing speed of the boat and how the water line W then is positioned. The speed will typically be in the range of 4–15 knots. The propeller 3 is engaged, but has relatively low rotational speed. At a certain speed the water turbine 4 will drop out in that the suction 20 is lifted out of the water.

Figure 3C:
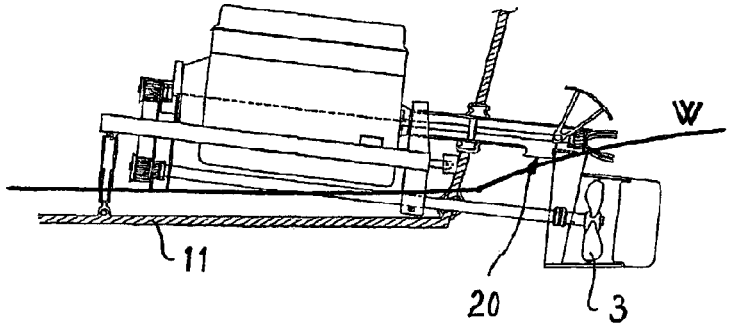

FIG. 3C shows planing speed and how the water line W then is positioned. Typical speed will be 15–25 knots. The propeller 3 has higher rotational speed and the water turbine 4 including the suction 20 is completely out of the water. The water turbine 4 will continue to rotate, since it is directly coupled to the power take-off, but has no function.

Figure 3D:
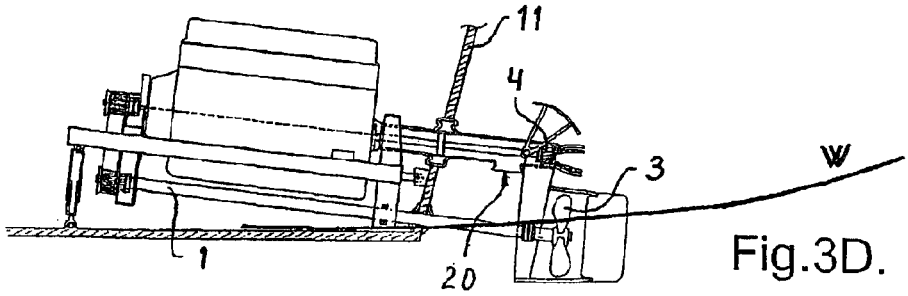

FIG. 3D shows super speed and how the water line W then is positioned. Typical speed will be over 25 knots. The propeller 3 has high rotational speed and the water turbine 4 is rotating, but the turbine is not in action. In order to obtain this state, a surface acting propeller is normally needed.

Figure 4A:
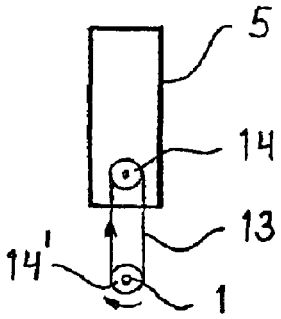
Figure 4B:
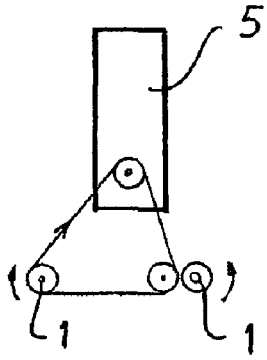

It is to be understood that the propulsion aggregate can be combined in many ways in regard of number of engines, the placement of the engines, type of engines such as straight and V-engines, number of propeller shafts and the sense of rotation thereof. FIGS. 4A–D illustrate some of the possibilities of combination. FIG. 4A shows one engine and one propeller shaft. The arrow shows the sense of rotation. FIG. 4B shows one engine and two propeller shafts and related senses of rotation. Note that a gear or the like is needed to alter the sense of rotation of one of the shafts. Always when it is two propellers in question, they should rotate in opposite sense in order to obviate that the boat is pulled aside.

Figure 4C:
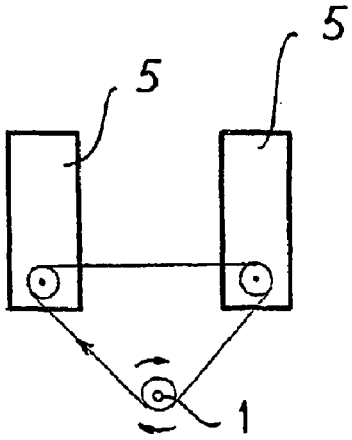
Figure 4D:
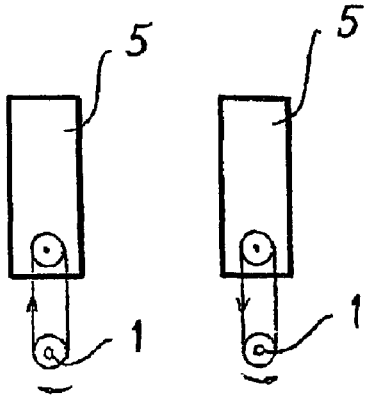

FIG. 4C shows two engines and one drive shaft. One variant of the propulsion aggregate shown in FIG. 4C, is two engines driving one another propeller shaft in which the one shaft is lying centrally within the other, a duo prop aggregate. In duo prop aggregates, the propellers will rotate in opposite directions. FIG. 4D shows two engines and two drive shafts. The arrows show senses of rotation. It is further possible to arrange two (or more) engines after each other and operate one or two shafts as otherwise illustrated in FIGS. 4A–4D.

What is claimed is:

1. A propulsion aggregate for boats of planing type, which aggregate comprises at least one inboard engine disposed in a supporting frame, at least one first drive shaft having a propeller, which shaft extends through the boat hull at the stem section of the boat, and at least one rudder, wherein the aggregate comprises a second drive shaft that extends through the stem section of the boat and drives a water, turbine, the first drive shaft is operatively coupled to a power take-off of the engine via a releasable coupling and said first drive shaft is in operation during forward propulsion above a certain speed only, and the second drive shaft is connected to a power take-off of the engine and is arranged at a higher level than the propeller and said second drive shaft is in operation at forward propulsion at low speeds and at reverse motion of the boat.

2. A propulsion aggregate according to claim 1, characterised in that the propeller is a conventional boat propeller.

3. A propulsion aggregate according to claim 1, characterised in that the power take-off of the engine for the first drive shaft is directed forward of the boat, that the first drive shaft is extended to the power take-off and is connected to this via a power transmission unit, and the power take-off for the second drive shaft is directed rearwards.

4. A propulsion aggregate according to claim 1, characterised in that the power take-off of the at least one engine is common for the first and the second drive shafts and are directed rearward of the boat and the first drive shaft is connected to the power take-off via a power transmission unit.

5. A propulsion aggregate according to claim 3, characterised in that the power transmission unit is in form of a cogged belt and two supported pulleys that the cogged belt runs over.

6. A propulsion aggregate according to claim 1, characterised in that a third drive shaft corresponding to the first drive shaft, is arranged adjacent to and spaced apart from the first drive shaft, but at same level, and the power transmission unit is so arranged that the shafts rotate in opposite directions.

7. A propulsion aggregate according to claim 1, characterised in that the aggregate has two inboard engines placed adjacent to each other and is so arranged that they have respective drive shaft and propeller rotating in opposite directions.

8. A propulsion aggregate according to claim 1, characterised in that the aggregate has two inboard engines placed adjacent to each other and is so arranged that they have common drive shaft and propeller.

9. A propulsion aggregate according to claim 1, characterised in that the propulsion aggregate is tiltable about a substantially horizontal axis that is located near the stern section of the boat.

10. A propulsion aggregate according to claim 9, characterised in that the propulsion aggregate is tiltable about said substantially horizontal shaft by means of at least one working cylinder located near the front end of the support frame.

11. A propulsion aggregate according to claim 1, characterized in that the propeller is a surface acting propeller of the type designed for speed boats.

* * * * *